US008793818B2

(12) United States Patent
Inglin et al.

(10) Patent No.: US 8,793,818 B2
(45) Date of Patent: Aug. 5, 2014

(54) METHOD FOR FLUSHING A TOILET BOWL HAVING A SIPHON, AND WC

(75) Inventors: Urs Inglin, Lachen (CH); Abdullah Oengoren, Sirnach (CH)

(73) Assignee: Geberit International AG, Jona (CH)

( * ) Notice: Subject to any disclaimer, the term of this patent is extended or adjusted under 35 U.S.C. 154(b) by 974 days.

(21) Appl. No.: 12/898,372

(22) Filed: Oct. 5, 2010

(65) Prior Publication Data

US 2011/0078850 A1 Apr. 7, 2011

(30) Foreign Application Priority Data

Oct. 6, 2009 (EP) ..... 09405172

(51) Int. Cl.
*E03D 11/02* (2006.01)

(52) U.S. Cl.
USPC ..... 4/425

(58) Field of Classification Search
USPC ..... 4/428, 425
See application file for complete search history.

(56) References Cited

U.S. PATENT DOCUMENTS

| | | | | |
|---|---|---|---|---|
| 1,132,953 | A * | 3/1915 | Mann | 4/425 |
| 1,182,085 | A * | 5/1916 | Graham | 4/425 |
| 5,054,133 | A * | 10/1991 | Pickerrell et al. | 4/428 |
| 6,145,138 | A | 11/2000 | Nakamura et al. | |
| 2007/0199138 | A1 | 8/2007 | Zhurin et al. | |

FOREIGN PATENT DOCUMENTS

| | | |
|---|---|---|
| DE | 692 05 074 T2 | 3/1996 |
| DE | 20 2006 012072 U1 | 7/2007 |
| GB | 471058 | 8/1937 |
| GB | 519533 A | 3/1940 |
| WO | 2004/082447 A2 | 9/2004 |

* cited by examiner

*Primary Examiner* — Huyen Le
(74) *Attorney, Agent, or Firm* — Sughrue Mion, PLLC

(57) ABSTRACT

The WC has a toilet bowl and a flushing arrangement by means of which, in a flushing operation, the toilet bowl is supplied with water as a flushing stream in order to flush out the contents of the bowl and to clean the bowl surface. The flushing arrangement has means which, during a flushing operation, use water to clean the bowl surface in a transition region from the bowl to the siphon, the cleaning power of this water being directed specifically at this transition region.

7 Claims, 1 Drawing Sheet

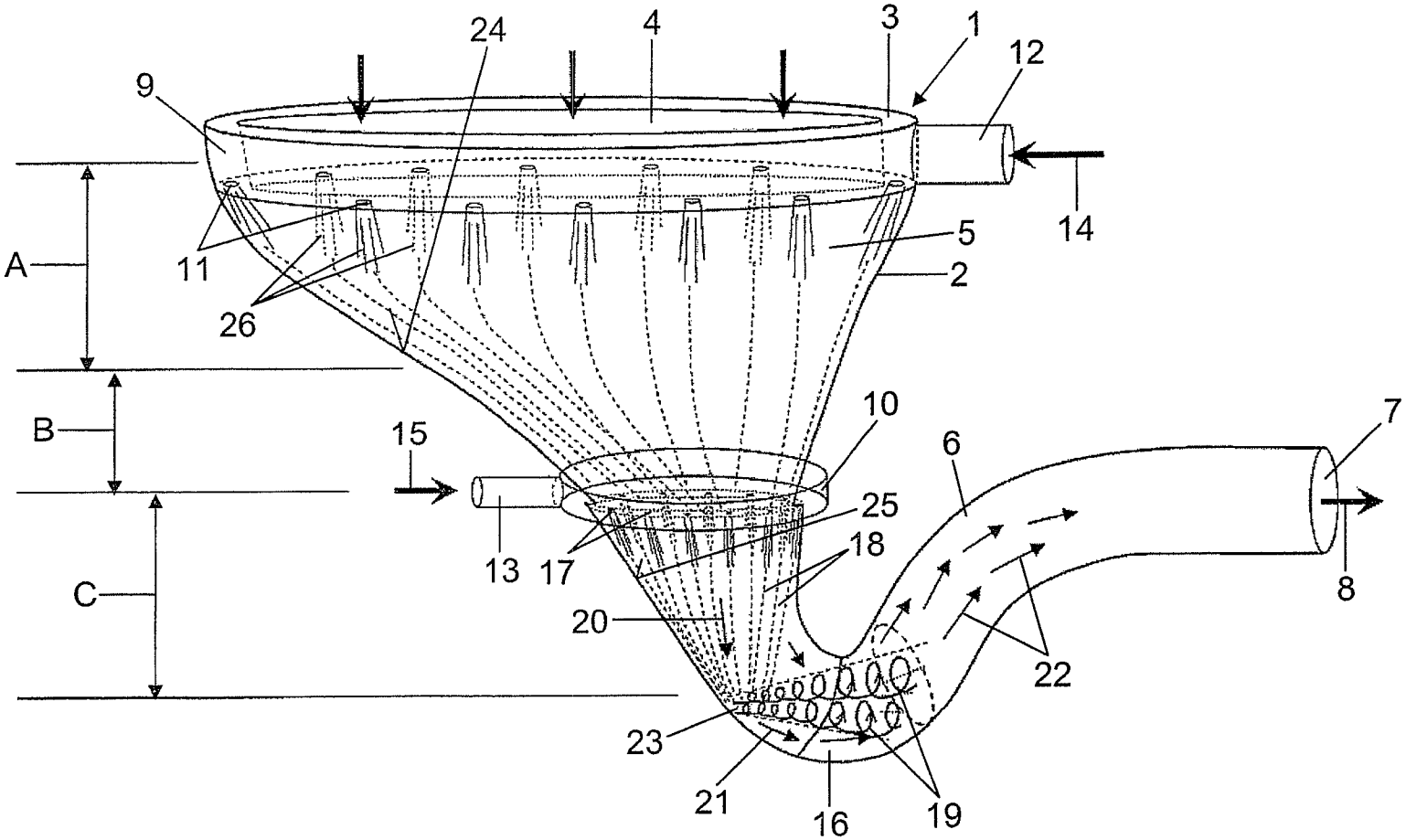
1
2
3
4
5
6
7
8
9
10
11
12
13
14
15
16
17
18
19
20
21
22
23
24
25
26
A
B
C

METHOD FOR FLUSHING A TOILET BOWL HAVING A SIPHON, AND WC

The invention relates to a method for flushing a toilet bowl which has a siphon and forms part of a WC that has a flushing arrangement by means of which, in a flushing operation, the toilet bowl is supplied with water as a flushing stream.

WCs are generally known. In conjunction with a suitable sewage system and water supply, they have proven successful from hygienic and functional points of view. As is known, such toilet facilities consist in each case of a flushing arrangement and a toilet pan. The flushing arrangement should be designed such that, during a flushing operation, it produces a flushing action which is sufficient to flush out the contents of the bowl and to clean the bowl surface. The flushing action is dependent on the flushing power of the flushing water and on the quantity of flushing water, but also substantially on the shape of the toilet pan. The operation of flushing out the contents of the bowl can be improved by the contents of the stench trap being sucked out of the siphon and by what is known as a jet nozzle being arranged in the siphon. The cleaning of the bowl surface is frequently unsatisfactory in such toilet facilities, however, and so a toilet brush has to be employed for subsequent cleaning. However, such subsequent cleaning, as is known, is not very desirable.

It is the object of the invention to create a method of the type mentioned which ensures a better cleaning action and thus usually renders subsequent cleaning unnecessary.

The object is achieved in a method of the type in question, in that the flushing arrangement has means which, during a flushing operation, use water to clean the bowl surface in a transition region from the bowl to the siphon, the cleaning power of this water being directed specifically at this transition region. The invention is based on the finding that, after the WC has been used, said transition region is usually soiled substantially more heavily than the region of the bowl surface above it. The specific cleaning of this region means that subsequent cleaning can be avoided in most cases.

Said transition region can be cleaned particularly effectively and with comparatively little water when, in accordance with a development of the invention, the means are designed in the form of a flushing nozzle ring and at least some of the water jets discharged by the flushing nozzle ring are directed towards said transition region. Such water jets have a particularly good cleaning power and can also correspondingly be directed specifically towards this transition region.

According to a development of the invention, the means are arranged in a toilet seat. This allows these means to be realized in a particularly suitable manner. The nozzles can be arranged on an underside of the toilet seat and be directed towards the transition region. The means preferably form a flow cone which tapers downwards and is directed towards said transition region. This allows particularly effective cleaning of this transition region.

According to a development of the invention, the bowl surface above said transition region is cleaned by further means of the flushing arrangement. These further means thus clean a region which is usually minimally soiled. These means can be designed in the form of a conventional flushing channel in the upper rim of the toilet bowl. However, cleaning of the region with nozzles arranged in the toilet seat is also possible. These nozzles can be designed in particular in the form of fan jet nozzles. These are then directed specifically at this region.

The invention also relates to a WC which can be flushed using the method according to the invention. Said WC comprises a flushing arrangement and a toilet bowl having a siphon. The WC is characterized by the provision of means with which a transition region from the pan to the siphon can be cleaned specifically with water. According to a development of the invention, such a WC also comprises means for specifically cleaning the siphon. Such a WC comprises in particular two nozzle rings. A first nozzle ring, arranged at the top, is provided specifically for cleaning said transition region and a second nozzle ring is provided for cleaning the siphon. These means can be designed such that they act immediately during a flushing operation or afterwards. The two flushing rings can additionally act simultaneously or one after the other.

Further advantageous features are given in the dependent patent claims, the following description and the drawing.

An exemplary embodiment of the invention is explained in more detail hereinbelow with reference to the single FIGURE. The single FIGURE schematically shows a three-dimensional view of a WC according to the invention.

The WC 1 shown in the single FIGURE has a toilet bowl 2, which has an upper rim 3 with an opening 4 and also a pan 5 and a siphon 6, which adjoins the pan at the bottom. The siphon 6 has a connection 7, which can be connected to a waste pipe of a sewage system. The outlet direction is indicated by the arrow 8. The toilet bowl 2 has a bowl surface 24, which merges into a siphon surface 25 of the siphon 6. These surfaces 24 and 25 can be subdivided into three regions A, B and C. The region A is located in the upper region of the pan 5 and is usually soiled only to a slight extent. The region B forms a transition region between the pan 5 and the siphon 6 and is usually soiled substantially more heavily than the region A. The region C is located inside the siphon 6 and is usually soiled even more heavily than the region B.

For example a cistern (not shown here) is provided in order to flush and clean the WC 1, the cistern storing water which is discharged to the toilet bowl 2 during flushing. Flushing can also take place, however, directly from a pressure line. The flushing arrangement comprises a first nozzle ring 9, which is connected via a connection stub 12 for example to a cistern. During flushing, water is supplied via the connection stub 12 to the first nozzle ring 9 in the direction of the arrow 14. This nozzle ring 9 has a multiplicity of nozzle openings 11, which are directed downwards. These nozzle openings 11 can be arranged at equal spacings or at unequal spacings. They are adapted to the cross section of the pan 5. This applies likewise to the direction of the nozzles 11. During flushing, the water flowing into the nozzle ring 9 exits the nozzles 11 in the form of water jets 26, which form a flow cone. The water jets 26 are directed specifically so that their cleaning power acts predominantly on the bowl surface 24 in the region B. As a result, the usually comparatively heavily soiled region B is cleaned by the water that exits the nozzle openings 11 in the form of the water jets 26. The water jets 26 exit the nozzles 11 at a comparatively high speed and thus have comparatively high energy and cleaning power. As a result, this transition region B can be cleaned particularly effectively. The nozzles 11 are preferably designed so that they form a full water jet, which is directed towards said transition region.

The first nozzle ring 9 can be connected securely to the pan 5. However, it can also be arranged in a toilet seat. This toilet seat can be connected securely or pivotably to the pan 5. This toilet seat thus has nozzles 11, which are provided at least in part for cleaning the transition region B. Nozzles which are directed towards the region A, and thus clean this usually less soiled region, are also possible here, however. These nozzles can then be designed in particular in the form of fan jet nozzles. The cleaning of the region A, however, can also be done using further means, which are formed for example by a flushing channel. These further means for cleaning the region A can likewise be designed in the form of a nozzle ring.

The WC 1 preferably has a second nozzle ring 10, which has a connection stub 13, to which flushing water is likewise supplied in the direction of the arrow 15. The flushing water can likewise originate for example from the cistern (not shown here). This second nozzle ring 10 is arranged below the first nozzle ring 9 in the descending region of the siphon 6 and at a distance from the first nozzle ring 9. It has nozzle openings 17, which generate water jets 18, which are directed towards a wall 23 of the siphon 6. The second nozzle ring 10 is located approximately level with the water in the siphon or above this level. The water flowing through the nozzles 17 into the siphon 6 accelerates the water in the siphon and the components present therein and conveys these in the directions of the arrows 21 and 22 towards the outlet 7. The water jets 18 form a flow cone, which is focused on the wall 23. The direction is indicated by the arrow 20. The water discharged by the nozzles 17 is reflected at the wall 23 and forms a vortex 19, which extends, as can be seen, into the U-bend 16 of the siphon 6. The vortex 19 increases the flushing action and also the cleaning action. The second nozzle ring 10 thus generates a flushing stream for flushing out the contents of the bowl and, in addition, brings about intensive cleaning of the siphon surface 25 in the descending region of the siphon 6 and also in the region of the U-bend 16.

LIST OF REFERENCE SIGNS

1 WC
2 Toilet bowl
3 Rim
4 Opening
5 Pan
6 Siphon
7 Outlet
8 Arrow
9 First nozzle ring
10 Second nozzle ring
11 Nozzle openings
12 Connection stub
13 Connection stub
14 Arrow
15 Arrow
16 U-bend
17 Nozzle openings
18 Water jets
19 Vortex
20 Arrow
21 Arrow
22 Arrow
23 Wall
24 Bowl surface
25 Siphon surface
26 Water jet

The invention claimed is:

1. A WC comprising:

a toilet bowl which has a siphon and a flushing arrangement by means of which, in a flushing operation, the toilet bowl is supplied with water as a flushing stream in order to flush out the contents of the bowl and to clean the bowl surface, wherein the flushing arrangement has means which, during a flushing operation, use water to clean the bowl surface in a transition region from the bowl to the siphon, the cleaning power of this water being directed specifically at this transition region, wherein said means are designed in the form of a first nozzle ring and at least some of the water jets discharged by the first nozzle ring are directed towards said transition region, wherein the siphon is cleaned by further means which are a second nozzle ring, and wherein said second nozzle ring is located approximately level with the water in the siphon.

2. The WC according to claim 1, wherein the means in the form of the first nozzle ring are arranged in a toilet seat.

3. The WC according to claim 1, wherein the means in the form of the first nozzle ring form a flow cone which is directed downwards towards said transition region.

4. The WC according to claim 1, wherein the bowl surface above said region is cleaned by further means of the flushing arrangement.

5. The WC according to claim 4, wherein the further means are designed in the form of a flushing ring.

6. WC according to claim 1, wherein said means in the form of a first nozzle ring are arranged on an upper rim of the toilet bowl, and in that they are designed in particular in the form of a toilet seat.

7. WC according to one of claim 1, wherein the bowl has a non-round cross section, and in that said means are adapted to this cross section.

* * * * *